US005272783A

United States Patent [19]

Richardson et al.

[11] Patent Number: 5,272,783

[45] Date of Patent: Dec. 28, 1993

[54] BUTTERFLY MOP STRUCTURE

[75] Inventors: Holly M. Richardson, 133 N. Maple, Burbank, Calif. 91505; Betty J. Ross, Van Nuys, Calif.

[73] Assignee: Holly M. Richardson, Burbank, Calif.

[21] Appl. No.: 916,813

[22] Filed: Jul. 20, 1992

Related U.S. Application Data

[63] Continuation-in-part of Ser. No. 682,096, Apr. 5, 1991, Pat. No. 5,131,111.

[51] Int. Cl.[5] ..... B08B 13/00

[52] U.S. Cl. ..... 15/119.2; 15/244.1

[58] Field of Search ..... 15/105, 119.2, 244.1

[56] References Cited

U.S. PATENT DOCUMENTS 2,864,107 12/1958 Greenleaf ..... 15/119.2

*Primary Examiner*—Chris K. Moore

*Attorney, Agent, or Firm*—Nilsson, Wurst & Green

[57] ABSTRACT

An improved butterfly mop comprises a sponge member adapted to be either urged into a normal position for cleaning, or folded inwardly upon itself in a compressed position to facilitate squeezing of the sponge member, or folded outwardly upon itself into a retracted position with the underside of the sponge member exposed to facilitate maneuvering the sponge into narrow recesses or around tight corners. In one embodiment the butterfly mop comprises retraction members secured to the sponge member whereby the sponge member is easily forced into its retracted position.

12 Claims, 4 Drawing Sheets

FIG. 15
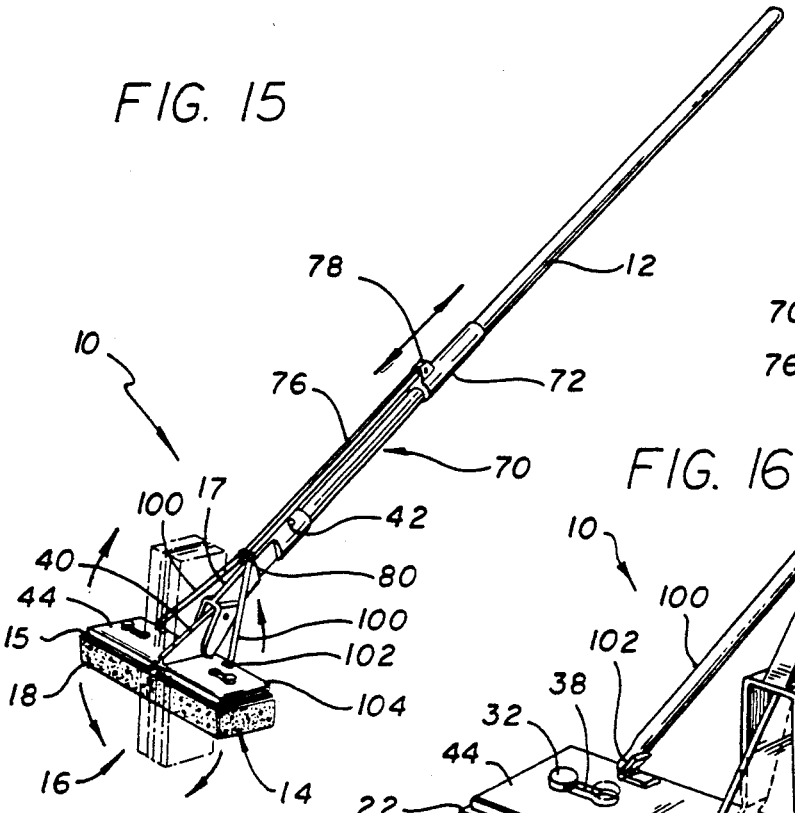
FIG. 16
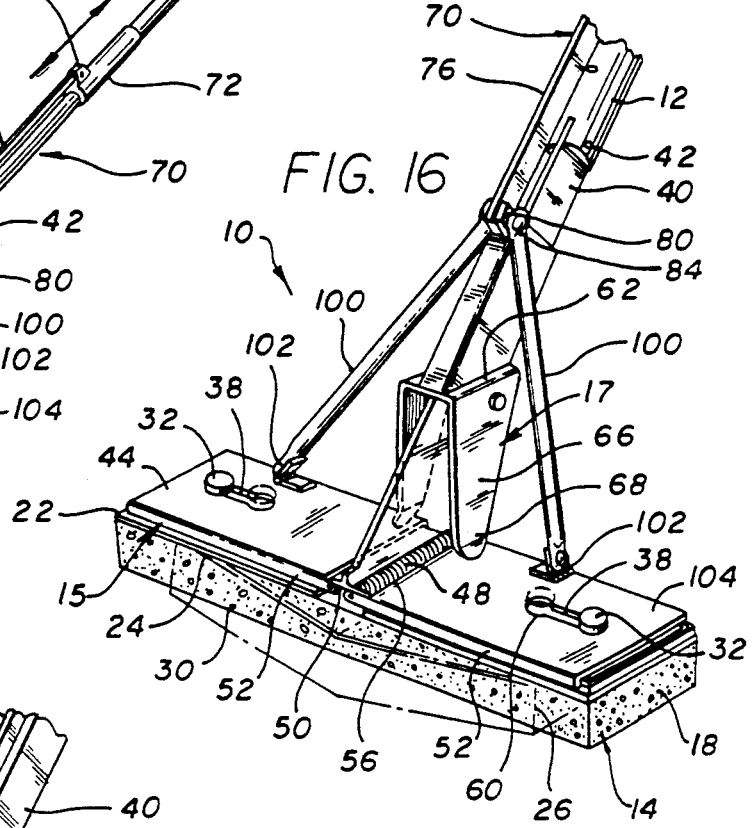
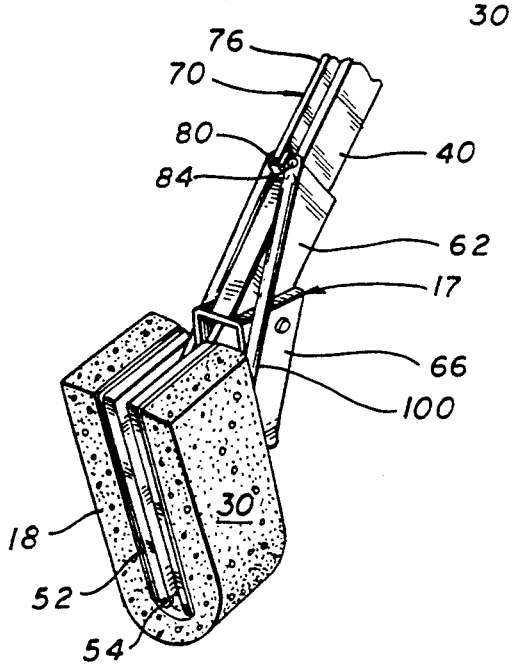
FIG. 17

BUTTERFLY MOP STRUCTURE

REFERENCE TO RELATED APPLICATIONS

This is a continuation-in-part of Application Ser. No. 07/682,096 filed Apr. 5, 1991 and entitled "Butterfly Mop Structure," now U.S. Pat. No. 5,131,111.

FIELD OF THE INVENTION

This invention relates to butterfly mops. In particular, this invention relates to a butterfly mop where the sponge member of the mop is adapted to be either urged into a normal position for cleaning, or folded inwardly upon itself and compressed to facilitate squeezing of the sponge member, or folded outwardly upon itself into a compact structure with the underside of the sponge member exposed to facilitate maneuvering the sponge into narrow recesses or around tight corners.

BACKGROUND AND SUMMARY OF THE INVENTION

Butterfly mops are known cleaning devices which include a handle having mounted at one end a sponge member which is adapted to be folded approximately in half and squeezed to remove water contained in the pores of the sponge. Typical mops are illustrated in the following patents:

| Inventor | Patent No. |
|---|---|
| J. Palama, Jr. et al. | 2,685,098 |
| P. S. Vosbikian et al. | 2,725,585 |
| H. Gantz | 2,730,741 |
| W. H. Richards et al. | 2,757,398 |
| F. Zottola | 2,730,743 |
| F. Zottola | 2,858,557 |
| P. S. Vosbikian et al. | 2,883,689 |
| A. E. Clements | 2,896,235 |
| F. B. Zottola | 2,916,754 |
| W. H. Richards | 2,967,317 |
| P. A. Morgan | 3,050,761 |
| W. H. Richards | 3,147,502 |
| K. Morrison et al. | 4,831,677 |
| D. A. Jones | 4,864,675 |
| U. K. Patent | 793,981 |

Prior art butterfly mops are characterized by complicated mechanical structures to compress the sponge member. Such complex mechanical structures are bulky, costly to manufacture and impossible to use in narrow recesses. As a general rule, butterfly mops are only designed to compress the sponge member and do not fold the sponge member outwardly upon itself to expose substantially all of the underside of the sponge member when so folded. This has not been recognized as a desirable attribute of butterfly mops until the present invention.

It is the object of the present invention to provide a butterfly mop which has a simplified mechanism for compressing the sponge member that also allows the sponge member to be folded outwardly upon itself to expose the underside of the sponge member. This provides a compact structure that fits into a narrow recess or around a tight corner normally inaccessible to conventional mops and that has a cleaning surface available for wiping the surfaces of the recess.

The device of this invention has several features, no single one of which is solely responsible for its desirable attributes. Without limiting the scope of this invention as expressed by the claims which follow, its more prominent features will now be discussed briefly. The features of the present invention provide a butterfly mop having numerous advantages over the prior art, which include compactness, simplicity of construction, and convenience and versatility of use.

A first feature is that the mop has a sponge holder comprising a pair of wing members having spring-biased hinges which enable the wing members to rotate either 90° toward the handle or 90° away from the handle. The spring-biased hinges normally position the wing members in line with one another at a right angle with respect to the handle. This normal position is used for most cleaning applications.

A second feature is a U-shaped member which moves toward and away from the wing members between a normal position, a forward (downward) position and a retracted (upward) position. In the normal position, the U-shaped member engages the wing members to maintain them at a right angle with respect to the handle. In the forward position, the U-shaped member engages the wing members to force these members to pivot inwardly about the hinges to compress the sponge member. In the retracted position, the U-shaped member disengages from contact with the wing members to permit these members to pivot outwardly so that the underside of the sponge member is exposed when the wing members are folded outwardly towards each other.

A third feature is a positioning, assembly, including a sleeve through which the handle passes. The sleeve has an internal track with opposed ends and a bend or jog between the opposed ends. The sleeve is mounted to rotate relative to the handle. The handle has a button which rides along the internal track. The button is located at the bend when the U-shaped member is in the normal position. The sleeve is rotated in one direction and moved toward the wing members to dislodge the button from the bend and allow the button to ride in the track as the U-shaped member is moved to the forward (down) compressed position. The sleeve is rotated in the opposite direction and moved in a rearward direction away from the sponge holder to dislodge the button from the bend and allow it to ride further rearward in the track as the U-shaped member is moved into the retracted (upward) position.

A fourth feature is that the wing members with a sponge member mounted thereon upon being folded can be compressed to a combined thickness of less than two inches. This enables the mop of the present invention to access narrow recesses and passageways. Thus, with the mop so folded and the underside of the sponge completely exposed in the retracted position, the user can insert the sponge member into a recess or around a tight corner and wipe the recess or corner surface with the underside of the folded sponge.

In accordance with an alternative embodiment, a pair of retraction members are attached at one end to each wing member by a hinge and at the other end to the U-shaped member. As the sleeve is moved to allow the U-shaped member to move to the retracted position, the retraction members force the wing members into the retracted position, with the underside of the sponge completely exposed.

These as well as other features of the invention will become apparent from the detailed description which follows, considered together with the appended drawings.

BRIEF DESCRIPTION OF THE DRAWINGS

The preferred embodiments of the present invention are illustrated in and by the following drawings in which like reference numerals indicate like parts and in which:

FIG. 15 is a perspective view of an alternative embodiment of the butterfly mop of the invention showing retraction members secured between the wing members and the U-shaped member;

FIG. 16 is an enlarged fragmentary perspective view showing the head end of the mop in accordance with the alternative embodiment of the present invention; and FIG. 17 is an enlarged fragmentary perspective view of the mop, showing the mop in the retracted position in accordance with the alternative embodiment of the present invention.

DETAILED DESCRIPTION OF THE PREFERRED EMBODIMENTS

Figure 1:
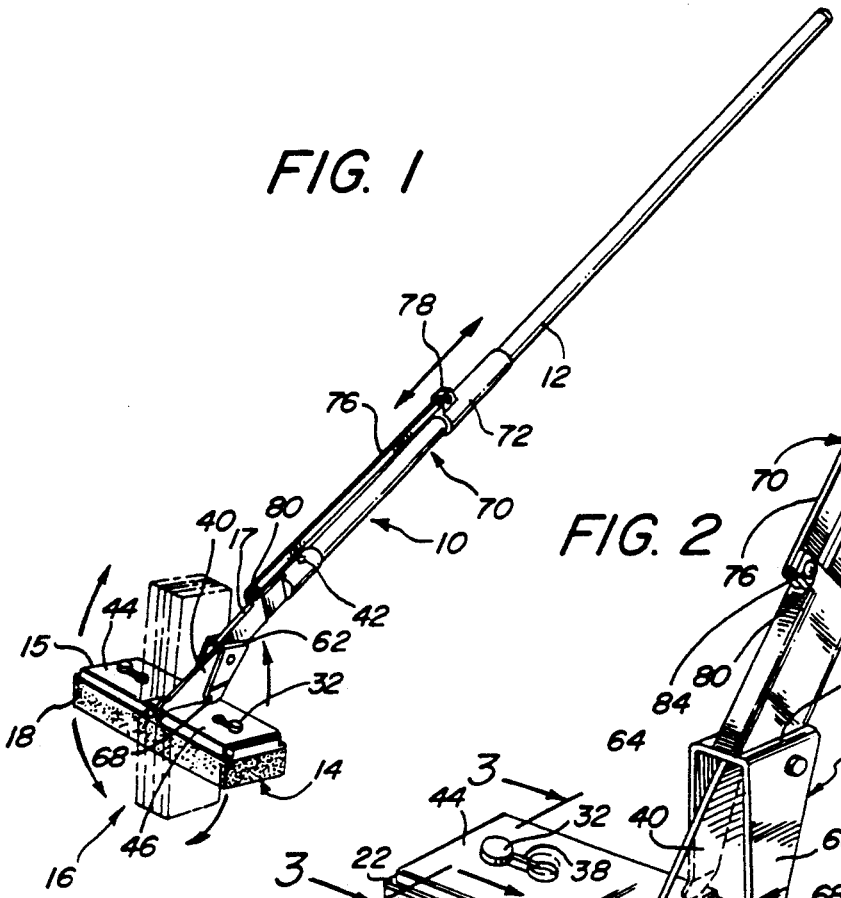
FIG. 1 is a perspective view of the butterfly mop of the invention.
Figure 2:
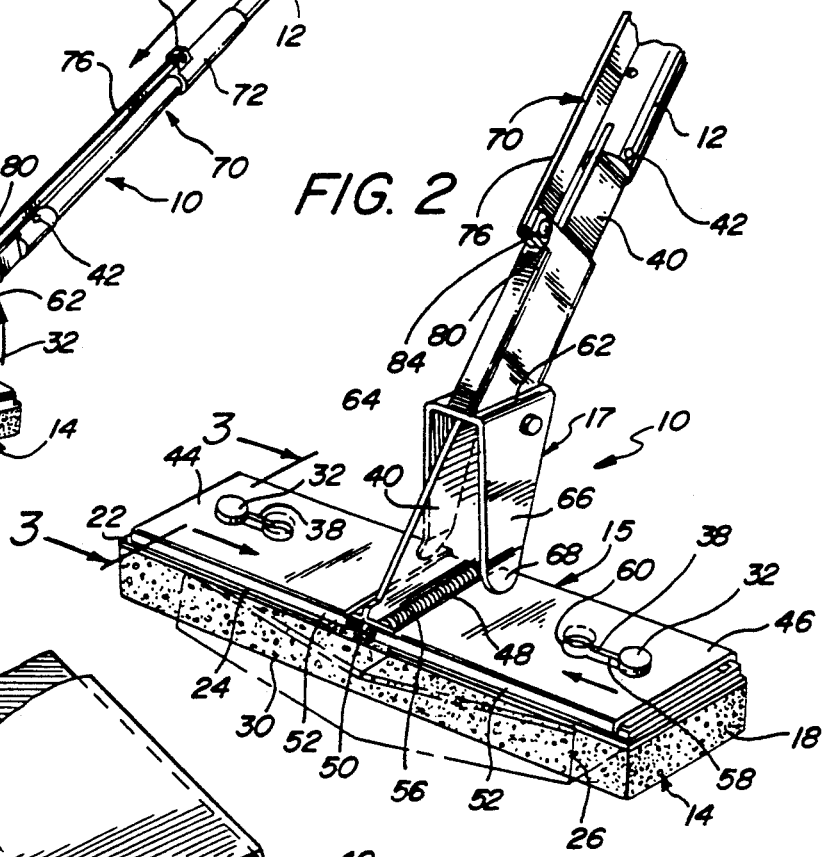
FIG. 2 is an enlarged fragmentary perspective view showing the head end of the mop.
Figure 3:
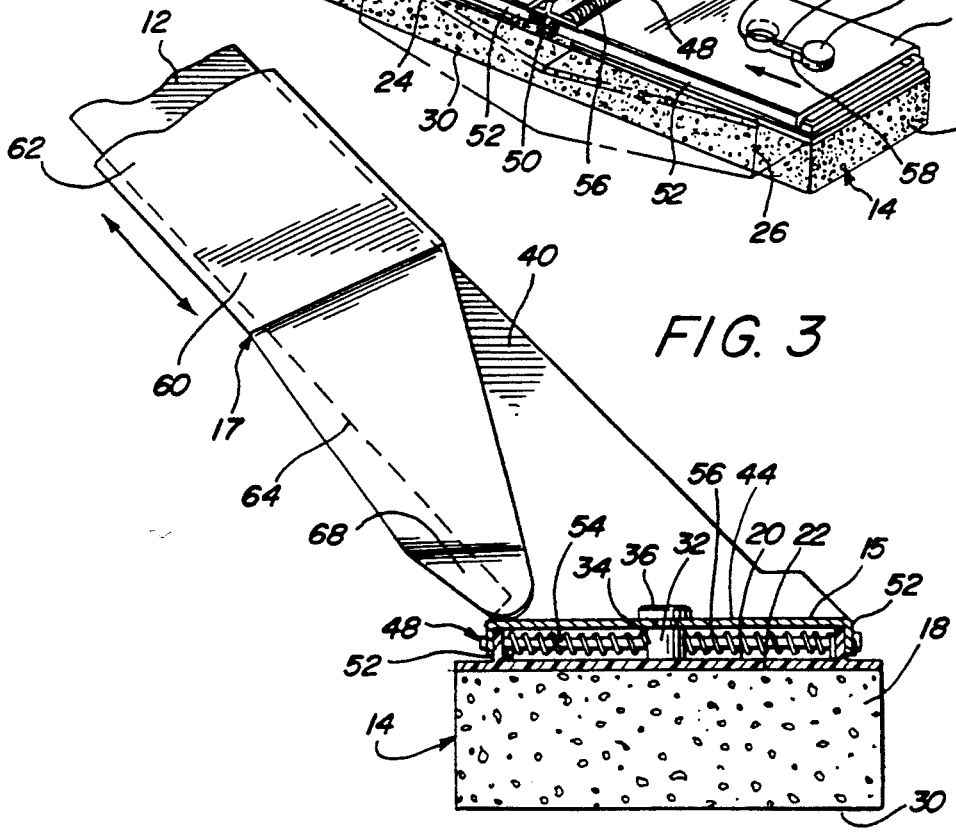
FIG. 3 is a cross-sectional view taken along line 3—3 of FIG. 2.

As illustrated in FIGS. 1 through 3, a butterfly mop of the present invention, indicated generally at 10, includes a handle 12 with a sponge member 14 removably attached to a sponge holder 15 at one end or at the head 16 of the handle 12. The sponge holder 15 cooperates with a manually movable U-shaped member 17 to allow the sponge member 14 to be folded into the different positions illustrated in FIGS. 4 and 5.

Figure 13:
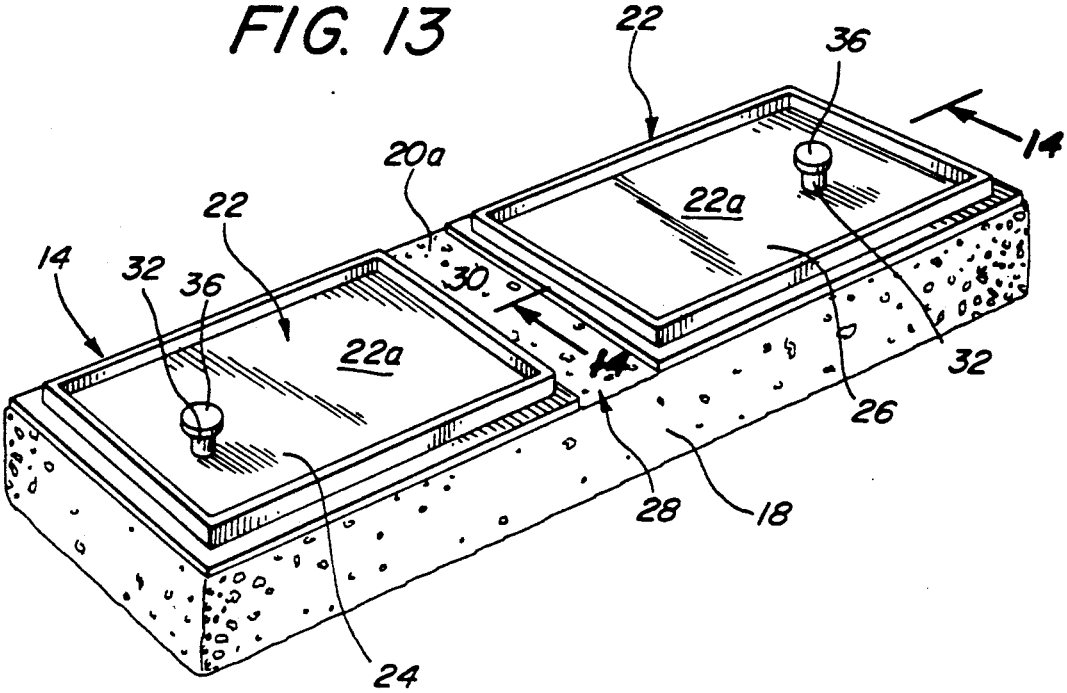
FIG. 13 is a perspective view of the sponge member of this invention.
Figure 14:
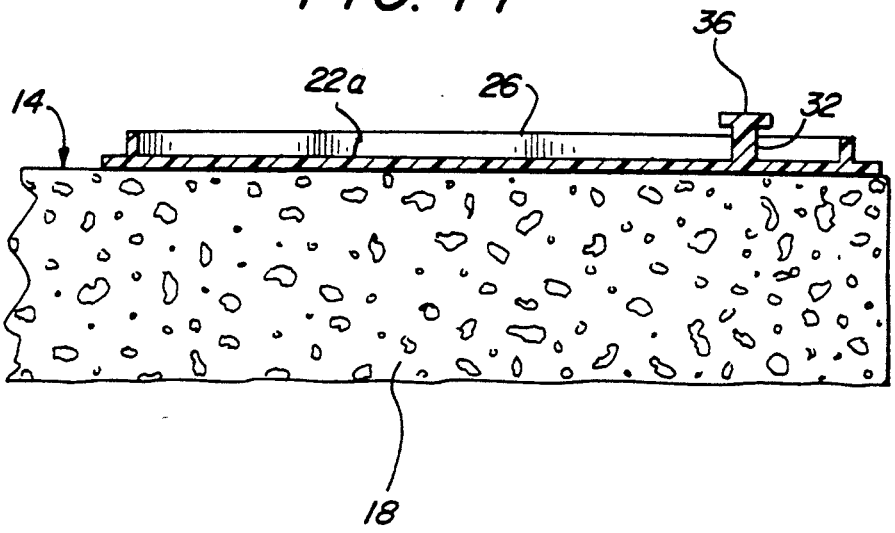
FIG. 14 is a cross-sectional view taken along line 14—14 of FIG. 13.

The sponge member 14 includes a rectangular block 18 of resilient synthetic sponge material, which has its upper surface 20 (best shown in FIG. 13) secured by an adhesive to the underside of a bifurcated carrier 22. This carrier 22 has two sections 24 and 26 spaced apart to provide a narrow gap 28 between the proximal ends of these sections The gap 28 exposes a central portion **20*a* (best shown in FIGS. 4 and 13) of the upper surface 20 of the sponge block 18, but the sections 24 and 26 cover substantially all the remaining upper surface 20 of the sponge block. The underside surface 30 of the sponge block 18** is completely uncovered.

Each of the sections 24 and 26 of the carrier 22 has an outwardly extending pin 32 near a distal end of each section. Each pin 32 has a shaft 34 terminating in an enlarged head 36. Because of this construction, the carrier sections 24 and 26 are adapted to bend inwardly toward each other as illustrated in FIG. 2 to align the pins 32 with receptacles 38 in the sponge holder 15. The pins 32 cooperate with the receptacles 38 to removably attach the sponge member 14 to the sponge holder 15. The carrier sections 24 and 26 are injection molded from a polymeric material with the pins 32 being integrally formed with the base **22*a*. The sponge member 14 is adapted to be attached to the sponge holder 15 whether the sponge block 18** is dry or wet, because of the resiliency of the sponge block.

Figures 4, 5, 6, 7, 8, 9, 10, 11, 12:
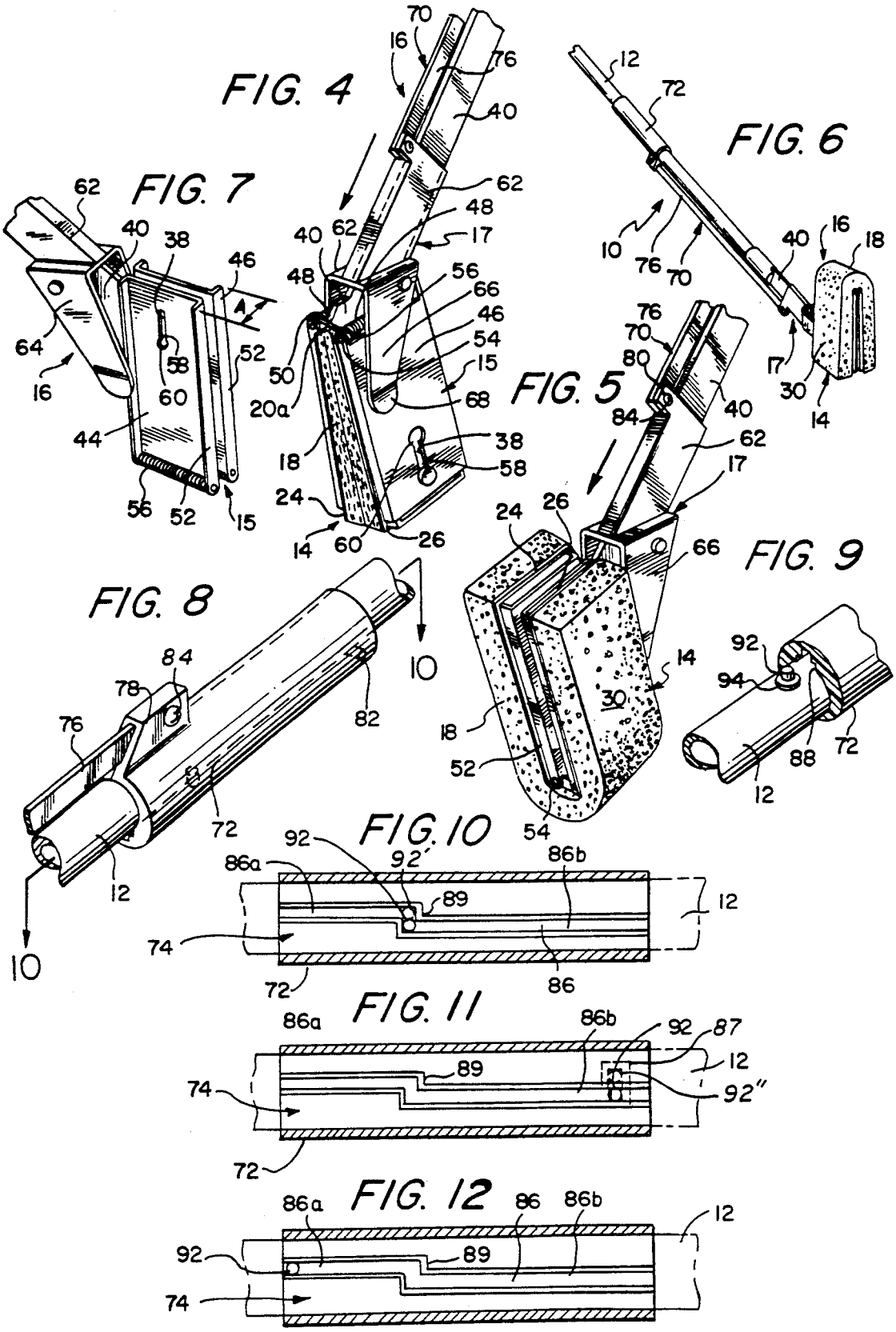
FIG. 4 is an enlarged fragmentary perspective view of the head end of the mop, with the U-shaped member moved to the forward position.
FIG. 5 is an enlarged fragmentary perspective view of the head end of the mop, with the U-shaped member moved to the retracted position.
FIG. 6 is a fragmentary perspective view of the head end of the mop in an inverted position and the U-shaped member moved forward to hold the sponge member in the outwardly folded position.
FIG. 7 is a fragmentary perspective view of the head end of the mop, with the sponge member removed, the wing members folded upwardly, and the retraction members holding the wing members in the retracted position.
FIG. 8 is a fragmentary perspective view of a portion of the handle of the mop, showing the sleeve which is manually moved to control the position of the U-shaped member.
FIG. 9 is a fragmentary perspective view of a segment of the handle of the mop inverted to show a button which rides in a track in the sleeve shown in FIG. 6.
FIG. 10 is a cross-sectional schematic view showing the position of the button relative to the track when the U-shaped member is in the normal position.
FIG. 11 is a cross-sectional schematic view showing the position of the button relative to the track when the U-shaped member is in the retracted position.
FIG. 12 is a cross-sectional schematic view showing the position of the button relative to the track when the U-shaped member is in the forward position.

The sponge holder 15 has a central T-shaped spline 40, having its upper end attached by a rivet 42 to the handle 12, and a pair of wing members 44 and 46 attached at their proximal ends by spring-biased hinges 48 to the base 50 of the spline 40. The hinges 48 are designed to enable the wing members 44 and 46 to fold upon themselves as illustrated in FIGS. 4 and 5. The hinges 48 normally position the sponge member 14 in a conventional cleaning orientation or normal position as shown in FIG. 2. The manually actuated U-shaped member folds the sponge member 14 inwardly upon itself into the position shown in FIG. 4 to compress the sponge block 18 and squeeze water from it. The manually actuated U-shaped member also allows the sponge member to be folded outwardly upon itself, into the position shown in FIGS. 5 and 17 to expose the underside surface 30 of the sponge block when in this outwardly folded position. The hinges 48 are designed to allow the wing members 44 and 46 to rotate through an angle of about 90° in either direction from the normal position shown in FIG. 2, for a total of about 180° of rotation.

Each wing member 44 and 46 has along opposed edges a downwardly extending flange 52. Rods 54 (FIG. 3) extending between the opposed flanges 52 carry springs 56 coiled around the rods. The springs 56 normally position the wing members 44 and 46 so these wing members are generally at a right angle with respect to the spline 40, as shown in FIG. 2. Near the distal ends of the wing members 44 and 46, each of the receptacles 38 includes a narrow channel 58 which terminates in an enlarged opening 60 near the proximal end of the respective wing member.

The U-shaped member 17 straddles the clevis mount 40 which at one end is attached to the head 16 of the handle 12. This U-shaped member 17 includes a U-shaped open channel segment 60, having a connector section 62 at one end and a pair of downwardly extending legs 64 and 66 with the spline 40 between them. In the normal position shown in FIGURE 2, feet 68 of the legs 64 and 66 engage the top surface of the wing members 44 and 46 adjacent the hinges 48.

A positioning assembly 70 is used to move the U-shaped member 17 between the normal position shown in FIG. 2, the forward position shown in FIG. 4 and a retracted position shown in FIGS. 5 and 17. The positioning assembly 70 includes a two-piece sleeve 72 having a hollow center 74 which receives the handle 12 therethrough, and a rigid arm 76 which is securely attached at one end to an ear 78 (best shown in FIGS. 1 and 8) of the sleeve 72 and at the other end to an ear 80 of the clevis connector section 62. The sleeve 72 is adapted to move laterally to and from along the length of the handle 12 or to rotate through limited angles, either clockwise or counterclockwise, relative to the handle. The arm 76 has sufficient flexibility to allow the sleeve 72 to rotate but is sufficiently rigid to push or pull the clevis 17 as the sleeve is moved along the length of the handle 12.

The two pieces of the sleeve 72 are attached by a screw 82 (shown in FIG. 8) extending through the body of the sleeve and a rivet 84 extending through the connector section 78. As illustrated in FIGS. 10 through 12, the assembled pieces of the sleeve 72 form an internal track 86 having an intermediate bend or jog 89 between opposed ends of the internal track 86 and two opposed flights 86*a* and 86*b*. The track 86 is formed in the internal wall of the sleeve 72 by a counterbore 88 adjacent a slot 90 shown in FIG. 9. A button 92 is securely attached to the handle 12 and has a washer 94 at its base. The button 92 rides in the slot 90 and the washer 94 rides in the counterbore 88 as the sleeve 72 is moved toward and away from the head 16 of the mop 10. In one embodiment, the screw 82 serves as a stop for the button 92 as it moves toward one end of the track 86.

When the U-shaped member 17 is in its normal position, as shown in FIG. 2, the wing members 44 and 46 of the sponge holder 15 extend outwardly and the button 92 is located at the bend 89 of the track 86, as illustrated in FIG. 10. With the sponge block resting on a floor, when the user applies downward pressure toward the head 16 of the mop 10, the button 92 remains lodged in position in the bend 89 and the feet 68 of the U-shaped member 17 engage the top surface of the wing members 44 and 46 to maintain these members in their normal position as illustrated in FIG. 2. Sufficient rigidity is thus provided so that the sponge member 14 is held in the position shown in FIG. 2 and functions in the conventional manner.

When the user is ready to compress the sponge member 14, the sleeve 72 is rotated to move the button 92 into alignment with the front flight 86*a* of the track 86. The user then pushes the sleeve 72 forward as illustrated by the arrow in FIG. 4 and the button 92 travels along the front flight 86*a* into the position illustrated in FIGURE 12. This moves the arm 76 downwardly which forces the U-shaped member 17 against the wing members 44 and 46 and folds these wing members forwardly about the hinges 48 as shown in FIG. 4. This action compresses the sponge block 18 between the wing members 44 and 46 and squeezes water from the sponge block. The U-shaped member 17 may also be left in this position as illustrated in FIG. 4 to store the mop 10.

Upon moving the sleeve 72 away from the head 16 of the mop 10, the button 92 rides along the front flight 86*a* of the track until it engages the bend 89, as indicated in phantom lines at 92' (FIG. 10). This disengages the U-shaped member 17 from the wing members 44 and 46, causing the springs 56 of the hinges 48 to urge the members back to the normal position illustrated in FIG. 2. Upon rotation of the sleeve 72 slightly as shown in FIG. 10 to bring the button 92 into alignment with the rear flight 86*b* of the track 86, and pulling the sleeve rearwardly to move it toward the upper end of the mop 10, as shown in FIG. 11, the clevis 17 is lifted away from the wing members 44 and 46. This enables the wing members 44 and 46 to be folded rearwardly as illustrated in FIG. 5 to expose the underside surface 30 of the sponge block 18 in the rearwardly folded position. The wing members 44 and 46 may be folded rearwardly by simply forcing them into a narrow recess or by grasping them and manually folding them outwardly. The U-shaped member may then be moved to its forward position where the feet 68 grasp between them the folded wing members 44 and 46, as illustrated in FIG. 7, to hold the sponge member 14 in the rearwardly folded position illustrated in FIG. 5.

Referring now to FIGS. 15, 16 and 17, in accordance with an alternative embodiment of the present invention, retraction members 100, which are preferably spring-loaded, extend between the wing members 44 and 46 at one end and the ear 80 of the clevis connector section 62 at the other end. The retraction members 100 are each connected to one of the wing members 44 and 46 by a suitable hinge 102 centrally disposed at an inner peripheral edge 104 of the wing members 44 and 46. Similarly, the retraction members 100 are secured to the ear 80 whereby the rigid arm 76 is rigidly held between the retraction members 100.

Upon rotation of the sleeve 72 slightly as shown in FIG. 10 to bring the button 92 into alignment with the rear flight 86*b* of the track 86, and pulling the sleeve 72 rearwardly to move it toward the upper ,end of the mop 10, as shown in FIG. 11, the U-shaped member 17 is lifted away from the wing members 44 and 46, causing the retraction members 100 to pull the wing members 44 and 46 into the outwardly folded position illustrated in FIG. 17. In practical situations, the wing members 44 and 46 may not fold back to the extent shown in FIG. 17.

The wing members 44 and 46 may be held in the outwardly-folded position of FIG. 17 by again rotating the sleeve 72 slightly to cause the button 92 to move out of the rear flight 86*b* of the track 86 and into a recess 87, as illustrated in phantom lines at 92,, in FIG. 11.

The total width A of the wing members 44 and 46 when folded either forwardly or rearwardly is compressible to less than two inches, typically one and one-third of an inch, including the sponge member 14. With the sponge holder 15 in the position shown in FIG. 5, the mop 10 can be used to access narrow passageways (for example, between a wall and a refrigerator).

Although the invention has been described in terms of the preferred embodiments thereof, other embodiments that are apparent to those of ordinary skill in the art are also within the scope of the invention. Accordingly, the scope of the invention is intended to be defined only by reference to the appended claims.

What is claimed is:

1. An improved butterfly mop, comprising:

a handle;

a sponge holder attached to the handle and having wing members adapted to hold a sponge, the wing members rotatable substantially forwardly into a compressed position and backwardly into a retracted position form a normal orientation wherein the wing members are in line with one another; and wing positioning structure mounted to the handle and the sponge holder the wing positioning structure having retraction member secured to the wing members, forward movement of the wing positioning structure from the normal orientation urging the wing member into said compressed position and backward movement of the wing positioning structure from the normal orientation pulling the retraction members backward so as to cause said wing members to fold back into said retracted position.

2. An improved butterfly mop as defined in claim 1, wherein said wing positioning structure further comprises:

a manually movable U-shaped member to allow said sponge member to be folded into different positions.

3. An improved butterfly mop as defined in claim 2, wherein said wing positioning structure further comprises:

a positioning assembly coupled to said clevis, said positioning assembly usable for moving said U-shaped member between the normal orientation, said compressed position and said retracted position, said positioning assembly adapted to move to and from along the length of said handle and to rotate through limited angles relative to said handle.

4. An improved butterfly mop as defined in claim 1, wherein said said retracted position said sponge member is compressible to a thickness of less than about two inches.

5. An improved butterfly mop as defined in claim 1, wherein said sponge member in said compressed position is further compressible to a thickness of less than about two inches.

6. An improved butterfly mop as defined in claim 5, wherein said handle has a protrusion extending therefrom, said protrusion adapted to ride along an internal track defined in said positioning assembly, said internal track having an intermediate bend between opposed front and rear flight paths, said protrusion being lodged in position in said bend when said U-shaped member is in said normal orientation and being aligned with one of said opposed flight paths upon rotational movement of said positioning assembly which causes said U-shaped member to engage the wing members and urge them into said compressed position or pull the wing members into said retracted position.

7. An improved butterfly mop as defined in claim 6 wherein said wing member as held in the retracted position by rotational movement of said positioning assembly in a direction which urges said protrusion into a recess disposed proximate said rear flight path.

8. An improved butterfly mop, comprising:

a handle;

a sponge holder attached to the handle and having wing members adapted to hold a sponge; and means for squeezing liquid from said sponge member by folding said sponge member in a first direction relative to the handle through an angle of about 90 degrees so that the sponge member when folded in the second direction is compressible to a thickness of less than about two inches, said sponge member also being adapted to be folded in a second direction opposite said first direction through an angle of about 90 degrees relative to the handle, so that the sponge member when folded in the second direction is compressible to a thickness of less than about two inches.

9. An improved butterfly mop, comprising:

a handle;

a sponge holder attached to the handle and having wing members rotatable substantially forwardly into a compressed position and backwardly into a retracted position from a normal orientation wherein the wing members are in lien with one another; and wing positioning structure mounted to the handle and the sponge holder the wing positioning structure in the normal orientation engaging the wing member to maintain said wing members in line with one another, the wing positioning structure in the compressed position engaging said wing members to use said wing members to pivot forwardly into said compressed position, and backward movement of the wing positioning structure from normal orientation resulting in rearward movement relative to said wing members such that said wing member pivot rearwardly into said retracted position.

10. An improved butterfly mop as defined in claim 9, further comprising:

actuator structure carried on the handle at a position remote from the sponge holder and connected to the wing positioning means which is manually actuated to locate said wing positioning structure in one of said normal orientation, said compressed position and said retracted position.

11. An improved butterfly mop, comprising:

a handle;

means for mounting a sponge attached to said handle, said mounting means being maintained in a normal orientation wherein the center of said mounting means is in line with opposing ends thereof, said mounting means from said normal orientation rotatable substantially forwardly about said center into a compressed position and backwardly about said center into a retracted position; and means for guiding said mounting means which is mounted to said handle, said guiding means having retraction members secured to said mounting means, forward movement of said guiding means from the normal orientation aging the wing members into said compressed position and backward movement of the wing positioning structure from the normal orientation causing the retraction members to fold back into said retracted position.

12. An improved butterfly mop a handle;

a sponge holder attached to the handle and having wing members rotatable substantially forwardly into a compressed position and backwardly into a retracted position from a normal orientation wherein the wing members are in line with one another; and wing positioning structure mounted to the handle and the sponge holder, the wing positioning structure in the normal orientation engaging the wing members to maintain said wing members in line with one another, the wing positioning structure in the compressed position engaging said wing members to urge said wing members to pivot forwardly into sad compressed position, and backward movement of the wing positioning structure from normal orientation permitting rearward movement relative to said wing members such that said wing members pivot rearwardly into said retracted position.

* * * * *

UNITED STATES PATENT AND TRADEMARK OFFICE

CERTIFICATE OF CORRECTION

PATENT NO. : 5,272,783

DATED : December 28, 1993

INVENTOR(S) : Holly M. Richardson et al.

It is certified that error appears in the above-identified patent and that said Letters Patent is hereby corrected as shown below:

Column 6, line 16, delete "outwardly";

Column 6, line 37, delete the comma (",") between "upper" and "end";

Column 7, line 32, after "wherein", delete "said" and substitute therefor --in--;

Column 8, line 17, delete "use" and substitute therefor --urge--;

Column 8, line 44, delete "aging" and substitute therefor --urging--.

Signed and Sealed this

Twenty-fourth Day of May, 1994

*Attest:*

Bruce Lehman

BRUCE LEHMAN

*Attesting Officer*

*Commissioner of Patents and Trademarks*